US009903129B1

(12) United States Patent
Boutin

(10) Patent No.: US 9,903,129 B1
(45) Date of Patent: Feb. 27, 2018

(54) INSULATING PANELS FOR ABOVE GROUND SWIMMING POOL

(71) Applicant: Yvon Boutin, Levis (CA)

(72) Inventor: Yvon Boutin, Levis (CA)

( * ) Notice: Subject to any disclaimer, the term of this patent is extended or adjusted under 35 U.S.C. 154(b) by 0 days.

(21) Appl. No.: 15/415,928

(22) Filed: Jan. 26, 2017

(51) Int. Cl.
*E04B 1/32* (2006.01)
*E04H 4/00* (2006.01)
*E04H 4/14* (2006.01)

(52) U.S. Cl.
CPC ..... *E04H 4/005* (2013.01); *E04H 4/14* (2013.01)

(58) Field of Classification Search
CPC ..... E04H 4/005; E04H 4/14
USPC ..... 52/245, 248
See application file for complete search history.

(56) References Cited

U.S. PATENT DOCUMENTS 2,423,488 A * 7/1947 Dowe ..... F24H 9/1818 219/526
3,208,084 A 9/1965 Collins et al.
3,396,500 A 8/1968 Lankheet
3,416,165 A * 12/1968 Pereira ..... E04H 4/142 220/565
5,018,324 A * 5/1991 Lankheet ..... E04H 4/142 52/169.7
5,025,601 A * 6/1991 Hand ..... E04H 4/0081 4/506
5,137,251 A * 8/1992 Jennings ..... E04G 9/10 249/10
5,590,493 A * 1/1997 Wilson ..... E04H 4/0043 249/18
5,652,972 A 8/1997 Chartrand
6,571,405 B1 * 6/2003 Saputo ..... E04H 4/0025 220/613
6,655,100 B1 * 12/2003 Andino ..... E04B 2/7457 249/18
7,464,417 B2 * 12/2008 Liu ..... E04H 4/0025 220/613
7,546,713 B2 * 6/2009 Bradley ..... E04H 4/141 52/102
8,640,275 B2 * 2/2014 Lawson ..... E04H 4/0025 4/506

* cited by examiner

*Primary Examiner* — Basil Katcheves

(57) ABSTRACT

An assembly comprising an above ground swimming pool having a circular wall and a plurality of support posts; a number of insulating panels configured and sized to fit between the plurality of support posts on the circular wall, wherein each of the number of insulating panels are held in place by arcuate bands and mounting brackets; and a number of decorative cladding sections positioned and placed over the insulating panels.

5 Claims, 3 Drawing Sheets

INSULATING PANELS FOR ABOVE GROUND SWIMMING POOL

CROSS-REFERENCE TO RELATED APPLICATIONS

N/A

BACKGROUND OF THE INVENTION

1. Field of the Invention

The present invention relates generally to swimming pools, but more particularly to insulating panels for an above ground swimming pool.

2. Description of Related Art

During cold nights, the water temperature in an above ground pools drops significantly in comparison to the water temperature in an in-ground pool because above ground pools do not get the benefit of the soil as insulation. Some manufacturers found a partial solution by using wood instead of steel, which improves the insulation between the water and the outside air. The wood also adds a decorative element. However, wood is rather expensive and is not the best insulating material when you take into account cost, weight, and R-value. Consequently, a better way to insulate above ground pools is described herein.

BRIEF SUMMARY OF THE INVENTION

In one embodiment of the present invention an assembly is provided, comprising an above ground swimming pool having a circular wall and a plurality of support posts; a number of insulating panels configured and sized to fit between the plurality of support posts on the circular wall, wherein each of the number of insulating panels are held in place by arcuate bands and mounting brackets; and a number of decorative cladding sections positioned and placed over the insulating panels.

In one embodiment, each of the number of insulating panels is held in place by at least two arcuate bands. In another embodiment, each arcuate band is attached to each of the number of insulating panels via a pair of mounting brackets and a first set of mechanical fasteners. In one embodiment, each mounting bracket is Z-shaped comprising a first section, a second section, and a third section. In yet another embodiment, the first section is inserted between the circular wall and a support post of the plurality of support posts.

In one embodiment, an insulating panel of the number of insulating panels has a first thickness, and an arcuate band of the at least two arcuate bands has a second thickness, wherein the second section extends perpendicularly from the first section and encompasses the first thickness of the insulating panel and the second thickness of the arcuate band. In another embodiment, the third section extends perpendicularly from the second section and parallel to the first section while covering an edge portion of the arcuate band, allowing the arcuate band to apply pressure and secure the insulating panel against the circular wall.

In one embodiment, each of the number of decorative cladding sections is attached via a second set of mechanical fasteners. In another embodiment, each of the number of insulating panels is constructed from an insulating material comprising a high thermal resistance value. In yet another embodiment, the insulating material is expanded polyethylene (EPE).

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out their invention. Various modifications, however, will remain readily apparent to those skilled in the art, since the general principles of the present invention have been defined herein to specifically provide insulating panels for an above ground swimming pool.

Figure 1:
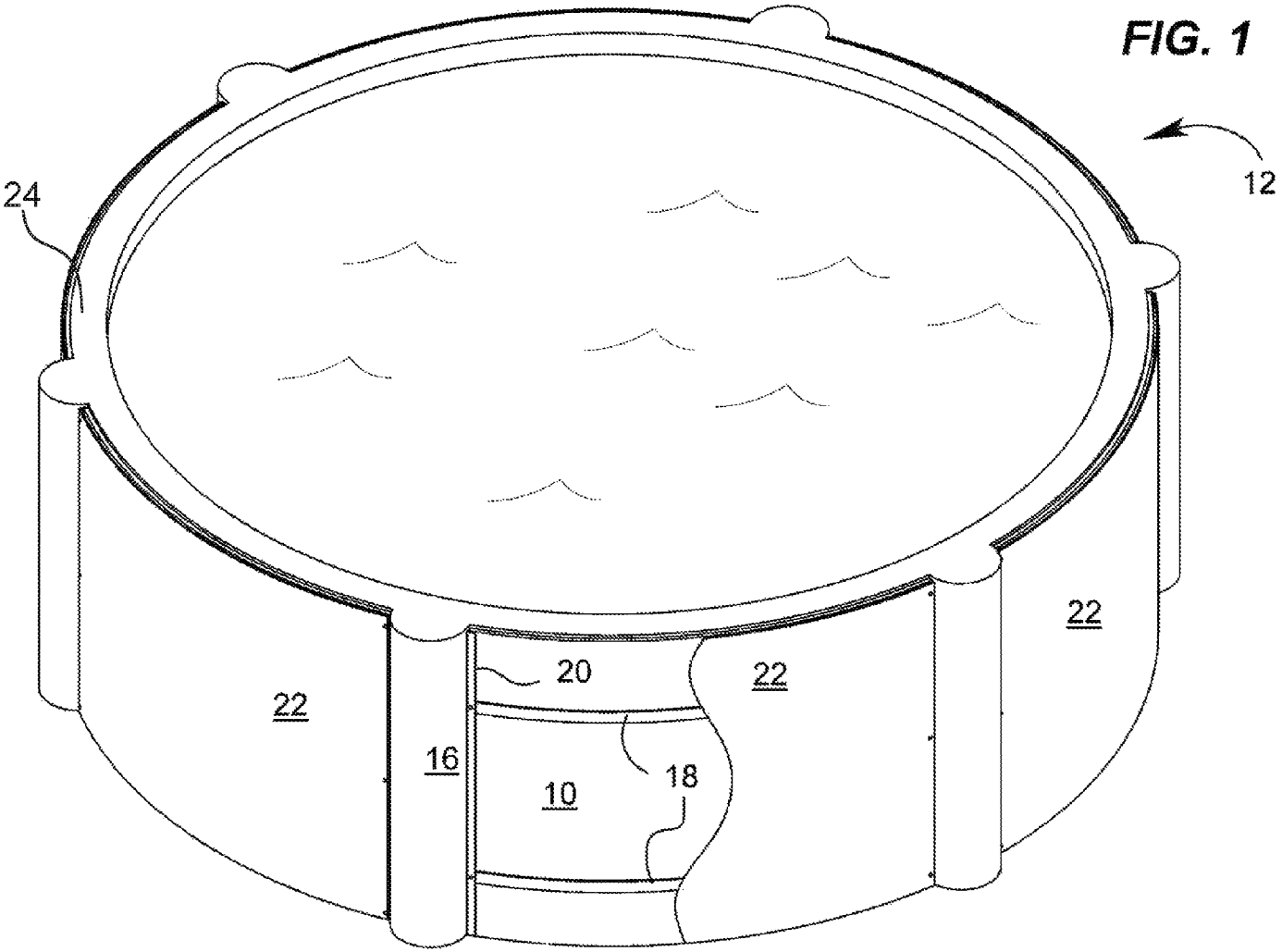
FIG. 1 illustrates a perspective view of insulating panels for an above ground swimming pool according to an embodiment of the present invention.

FIG. 1 illustrates a perspective view of insulating panels 10 for an above ground swimming pool 12 according to an embodiment of the present invention. Referring now to FIG. 1, the above ground swimming pool comprises a circular wall 24 and support posts 16, wherein the circular wall is constructed from a metallic material for retaining water as well known in the art. The insulation panels are configured and sized to fit between the support posts of the above ground pool. In one embodiment, the insulating panels are held in place by arcuate bands 18 and brackets 20 inserted between the support posts and the circular wall.

In one embodiment, the insulating panels are constructed from an insulating material chosen for its R-value and higher thermal resistance. An exemplary selection of the insulating material is Expanded Polyethylene (EPE), but other insulating materials may be used. When selecting the insulating material, aesthetic and durability properties are less critical than thermal resistance. Therefore, it is preferable to include a decorative cladding 22 positioned and placed over the insulating panels. In one embodiment, the decorative cladding is mechanically fastened to the brackets. In one embodiment, the decorative cladding is preferably constructed from a polymer having properties of Ultra Violet (UV) resistance, durability, and a material suitable for printing designs. However, it should be understood that as new material technologies emerge a single, integrated insulating panel and cladding may be used, and the step of including cladding for decorative purposes could be obsolete. Currently, the addition of decorative cladding is a viable option.

Figures 2A, 2B:
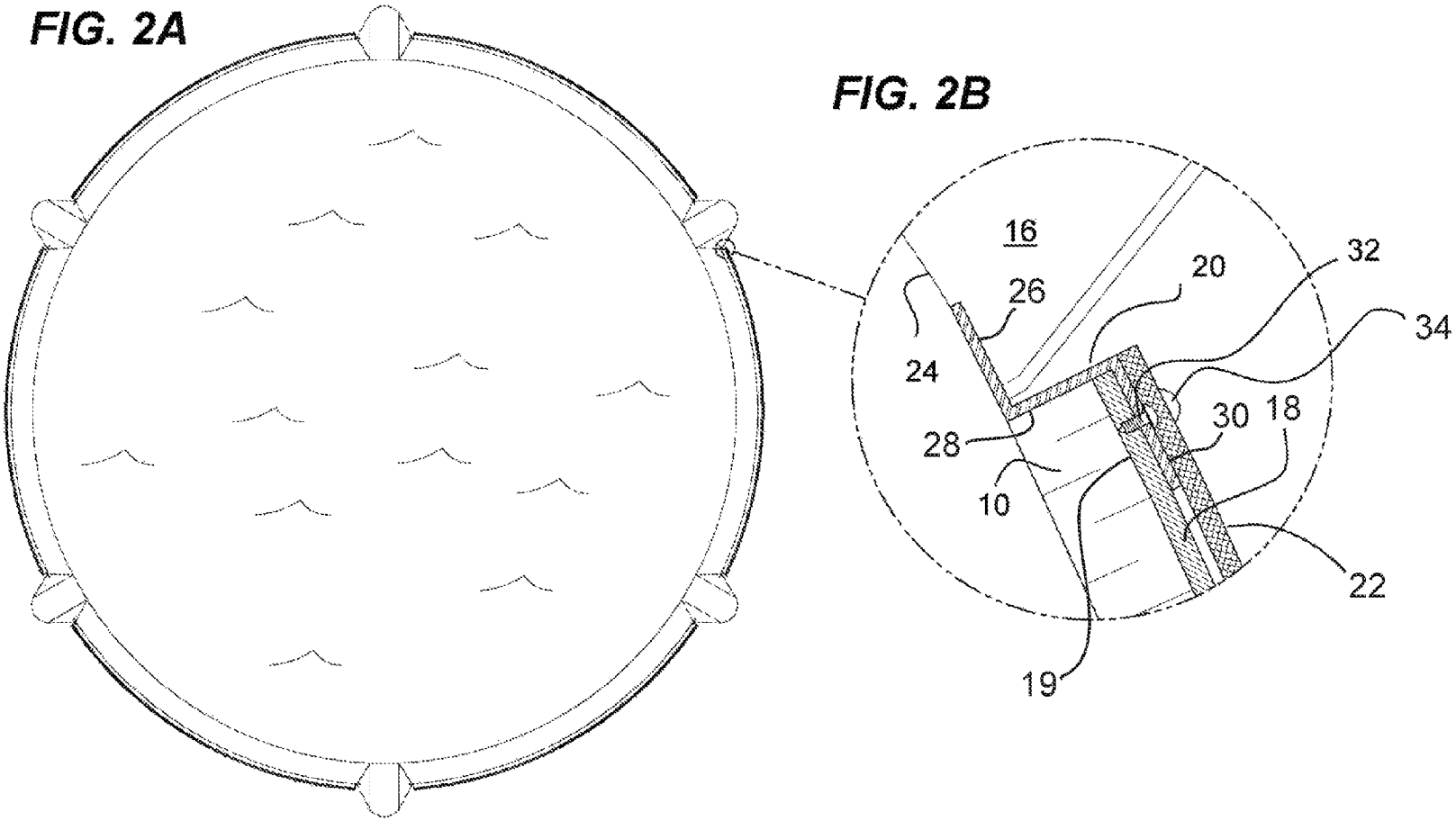
FIG. 2A illustrates a top view an above ground pool according to an embodiment of the present invention.
FIG. 2B is a detailed view of a mounting bracket for an insulating panel for the above ground pool of FIG. 2A.

Referring to FIGS. 2A-B, a holding bracket 20 is insulated. The holding brackets are generally Z-shaped comprising a first section 26, a second section 28, and a third section 30. The first section is inserted between the circular wall and the support posts. The second section extends perpendicularly from the first section and encompasses the thickness of the insulating panel and the arcuate band. The third section extends perpendicularly from the second section and parallel to the first section, while covering an edge portion 19 of the band allowing the band to apply pressure and secure the insulating panels against the circular wall.

In one embodiment, there are preferably two parallel bands per insulating panel, but more bands may be included, especially for very deep above ground pools. Any variety of mechanical fasteners 32 can be used for attaching the arcuate bands 18 to the insulating panels. In one embodiment, a separate set of mechanical fasteners 34 may be used to attach the decorative cladding.

Figure 3A:
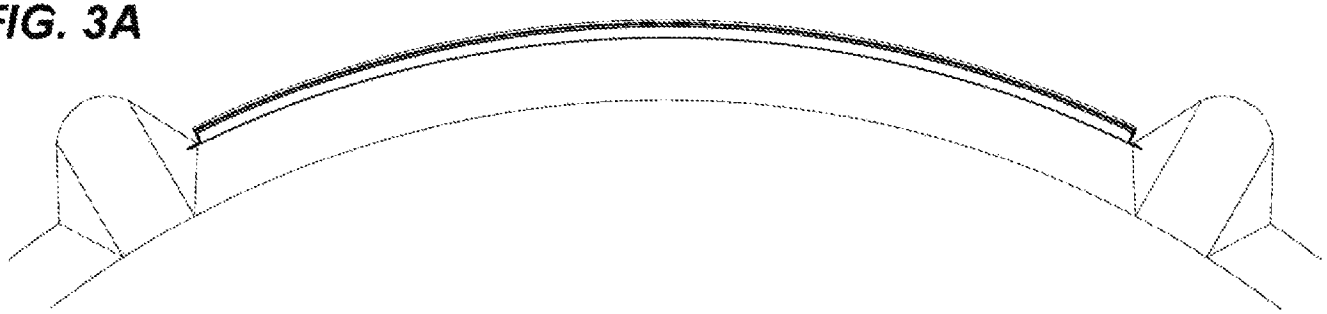
FIG. 3A is a top view of a section of an above ground pool according to an embodiment of the present invention.
Figure 3B:
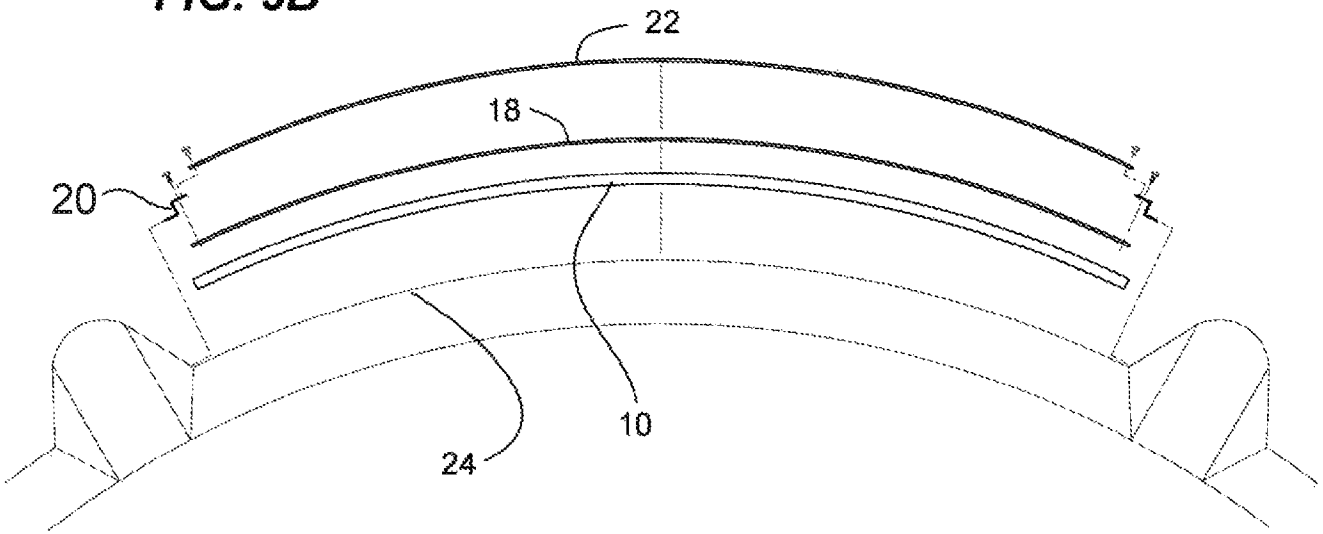
FIG. 3B is an exploded view of FIG. 3A.

FIGS. 3A-B show a top view and an exploded view illustrating how the insulating panels, arcuate bands, and decorative cladding are held and attached to the above ground pool via the brackets and mechanical fasteners.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. An assembly comprising:

an above ground swimming pool having a circular wall and a plurality of support posts;

a number of insulating panels configured and sized to fit between the plurality of support posts on the circular wall, wherein each of the number of insulating panels are held in place by arcuate bands and mounting brackets;

a number of decorative cladding sections positioned and placed over the insulating panels;

each of the number of insulating panels is held in place by at least two arcuate bands;

each arcuate band is attached to each of the number of insulating panels via a pair of mounting brackets and a first set of mechanical fasteners;

each mounting bracket is Z-shaped comprising a first section, and second section, and a third section;

the first section is inserted between the circular wall and a support post of the plurality of support posts;

an insulating panel of the number of insulating panels has a first thickness, and an arcuate band of the at least two arcuate bands has a second thickness, wherein the second section extends perpendicularly from the first section and encompasses the first thickness of the insulating panel and the second thickness of the arcuate band.

2. The assembly of claim 1, wherein a third section extends perpendicularly from the second section and parallel to the first section while covering an edge portion of the arcuate band, allowing the arcuate band to apply pressure and secure the insulating panel against the circular wall.

3. The assembly of claim 1, wherein each of the number of decorative cladding sections is attached via a second set of mechanical fasteners.

4. The assembly of claim 1, wherein each of the number of insulating panels is constructed from an insulating material comprising a high thermal resistance value.

5. The assembly of claim 4, wherein the insulating material is expanded polyethylene (EPE).

* * * * *